US005755528A

United States Patent [19]

Kulp et al.

[11] Patent Number: 5,755,528

[45] Date of Patent: May 26, 1998

[54] UNITARY STABILIZING BASE

[75] Inventors: Jack H. Kulp, San Juan Capistrano; Samuel J. Bechtle, San Clemente, both of Calif.

[73] Assignee: TrafFix Devices, Calif.

[21] Appl. No.: 662,602

[22] Filed: Jun. 13, 1996

[51] Int. Cl.[6] ..... E01F 13/02; E01F 9/00; E01F 15/00

[52] U.S. Cl. ..... 404/6; 404/9; 116/63 P

[58] Field of Search ..... 404/6, 9; 256/1, 256/13.1; 116/63 P

[56] References Cited

U.S. PATENT DOCUMENTS

| | | | |
|---|---|---|---|
| 2,957,444 | 10/1960 | Boettler . | |
| 3,386,409 | 6/1968 | Dawson . | |
| 3,451,368 | 6/1969 | Keats . | |
| 3,952,690 | 4/1976 | Rizzo et al. . | |
| 4,083,033 | 4/1978 | Kulp et al. . | |
| 4,674,431 | 6/1987 | Cory | 116/63 P |
| 4,710,053 | 12/1987 | Kulp et al. | 404/9 |
| 4,973,190 | 11/1990 | Erwin et al. | 404/10 |
| 5,026,204 | 6/1991 | Kulp et al. . | |
| 5,199,813 | 4/1993 | Nagler . | |
| 5,201,599 | 4/1993 | Kulp et al. | 404/6 |
| 5,234,280 | 8/1993 | Cowan . | |
| 5,451,118 | 9/1995 | Wilkins et al. | 404/6 |
| 5,613,798 | 3/1997 | Braverman | 404/6 |
| B1 5,234,280 | 1/1995 | Cowan . | |

FOREIGN PATENT DOCUMENTS

| | | |
|---|---|---|
| 1184406 | 6/1959 | France . |
| 2615541 | 11/1988 | France . |
| 2125863 | 6/1982 | United Kingdom . |
| 2122239 | 1/1984 | United Kingdom . |

OTHER PUBLICATIONS

"Swintex Traffic Management Products" Swintex Limited.

"Plastic Safety Drum maximun visibility, handling convenience and economy" Plastic Safety Systems.

"When You Think Traffic Cones . . . " Work Area Protection Corp.

"Standfix System/ Standfix Flat Cone/ It Stands to Reason" American Transporation Equipment, Inc.

"le Sysème Monopode" Monopode S.A.

*Primary Examiner*—Tamara L. Graysay
*Assistant Examiner*—Gary S. Hartmann
*Attorney, Agent, or Firm*—Donald E. Stout

[57] ABSTRACT

A rubber stabilizing base includes a sidewall of a worn out steel belted radial tubeless truck tire. The sidewall is annularly shaped, with an inner edge and an outer edge. An intermediate portion of the rubber stabilizing base contacts the inner edge of the sidewall and joins the sidewall to the intermediate portion. A circumferential wall is connected to the intermediate portion. Both the intermediate portion and the circumferential wall are annular, and the circumferential wall includes at least one locking lip adapted to be engaged with the traffic channelizer drum to thereby connect the traffic channelizer drum to the unitary stabilizing base. An inner portion of the rubber stabilizing base has one or more steps disposed thereon. The steps are grippable by the hand of a user to facilitate easy movement of the rubber stabilizing base.

16 Claims, 3 Drawing Sheets

UNITARY STABILIZING BASE

FIELD OF THE INVENTION

The present invention relates generally to traffic channelizing devices for use in guiding and directing normal vehicle traffic around road and highway construction sites and the like and, more particularly, to ballast devices for such traffic channelizing devices.

BACKGROUND OF THE INVENTION

Traffic channelizing devices have been configured of a variety of different shapes and materials. A typical traffic channelizing device may comprise a hollow drum made of a relatively lightweight plastic material, which will not cause damage to a vehicle if the vehicle should accidentally strike the drum. Since these hollow plastic drums are relatively light in weight, a ballast is used with each plastic drum to prevent the drum from being inadvertently blown over or moved about by the wind and/or air blasts produced by passing vehicles.

Although sandbags have been used in the prior art as ballasts, these sandbags have several drawbacks. Many applications require at least two of these sandbags to be placed within, on, or against the base of the plastic drum to hold the drum in place. Each sandbag may weigh between 35 and 50 pounds. The sandbags must first be filled, and then transported and positioned in place within, on, or against the external base or flange of the drum at the job site. This task is labor intensive and significantly adds to the time, labor, and space requirements for setting up the drums. The sandbags are seldom filled to consistent weights, and the amount of sand used for ballasting often will be either insufficient or excessive. Sandbags are also susceptible to breakage and the potential danger of loose sand on the roadway. It has been found that sand on a dry driving pavement reduces the coefficient of friction between a tire and the road surface, which results in increasing emergency deceleration distances.

Sand-filled plastic bases like that disclosed in commonly assigned U.S. Pat. No. 5,026,204 to Kulp et al., as well as sandbags used with plastic bases are also commonly used to ballast channelizer drums. While the sand-filled plastic base is highly suitable for many applications, other uses may require a different ballast weight or a lower cost alternative. Furthermore, the use of sandbags in conjunction with plastic bases presents the same difficulty as when the sandbags are used directly on or against an external flange or base of the drum.

Some traffic channelizing devices in the form of detachable, two-piece channelizers and traffic cones are well known in the art. These devices store a pre-selected volume and weight of ballast therein. In such a two-piece traffic channelizer, for example, the base may be configured with an internal, upturned flange for storing ballast in the form of concrete or a particular material such as sand.

Other ballasting systems have used the side wall of a worn out steel belted radial tubeless truck tire for holding a drum or cone in an upright position. For example, in U.S. Pat. No. 5,234,280 to David A. Cowan, the diameter of the sidewall is large enough to fit over the outside diameter of the drum, but is small enough to rest around the lower flange portion of the drum. Both the installation and removal of the sidewall can be cumbersome, however. Initially, the sidewall must be raised above the top of the drum and then dropped over and around the drum so that the sidewall rests on the bottom larger-diameter flange portion of the drum.

Additionally, it has been necessary in practice to stack two or more sidewalls on top of one another about the drum in order to hold the drum in place during high winds or high speed (in excess of 45 MPH) traffic conditions. For removal, the heavy and bulky sidewall must be lifted back up and over the drum. None of the prior art systems have implemented a rubber stabilizing base, which can be installed and removed with relative ease, and which can efficiently and effectively ballast a traffic channelizing device in an upright position in all wind and traffic conditions.

SUMMARY OF THE INVENTION

The rubber stabilizing base of the present invention includes a sidewall of a worn out steel belted radial tubeless truck tire. The sidewall is annularly shaped, with an inner edge and an outer edge. An intermediate portion of the rubber stabilizing base contacts the inner edge of the sidewall and joins the sidewall to the intermediate portion. A circumferential wall is connected to the intermediate portion. Both the intermediate portion and the circumferential wall are annular, and the circumferential wall includes a locking lip adapted to be engaged with the traffic channelizer drum to thereby connect the traffic channelizer drum to the unitary stabilizing base.

The sidewall is generally annular in shape, and the intermediate portion and circumferential wall are also generally annular in shape. The sidewall, the intermediate portion, and the circumferential wall are all generally concentric. In addition to having an inner edge and an outer edge, the sidewall further includes a lower side for contacting a horizontal support surface and an upper side opposite the lower side. The intermediate portion contacts both the lower side of the sidewall and the upper side of the sidewall, and is molded around the lower and upper sides of the sidewall. An adhesive can be applied to the inner edge of the sidewall, before the intermediate portion is molded around the lower and upper sides of the sidewall. The intermediate portion and the circumferential wall are integrally molded together of non-vulcanized reclaimed rubber, and a strengthening agent can be added to the intermediate portion, or to both the intermediate portion and the circumferential wall, during the molding of the intermediate portion and the circumferential wall. According to one aspect of the present invention, an inner portion of the rubber stabilizing base has one or more steps disposed thereon. The steps are grippable by the hand of a user to facilitate easy movement of the rubber stabilizing base.

The present invention, together with additional features and advantages thereof, may best be understood by reference to the following description taken in connection with the accompanying illustrative drawings.

DESCRIPTION OF THE PREFERRED EMBODIMENT

Figure 1:
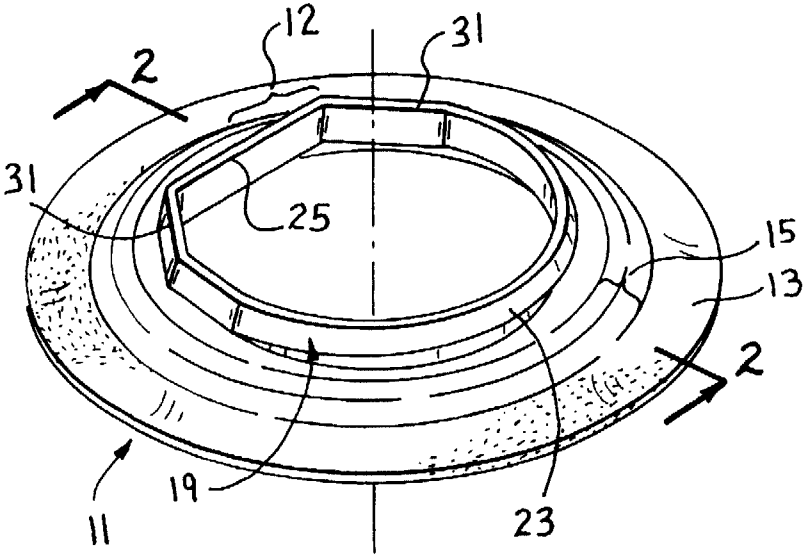
FIG. 1 is a perspective view of the unitary stabilizing base of a first preferred embodiment.

Turning to FIG. 1, a perspective view of a unitary stabilizing base 11, according to one preferred embodiment, is illustrated. The unitary stabilizing base 11 comprises a tire sidewall 13, an upper clamping portion 15, and a locking lip 19. The tire sidewall 13 is preferably taken from a worn out truck tire. The tire sidewall is oriented so that the thicker portion or bead 20 is located radially inwardly of the thinner portion. The use of the tire sidewall 13 allows for recycling of worn out truck tires, instead of disposal of these worn out truck tires in landfills, for example. In addition to using recycled tire sidewalls 13, the upper clamping portion 15, and the locking lip 19 are preferably molded of non-vulcanized reclaimed rubber.

Figure 2:
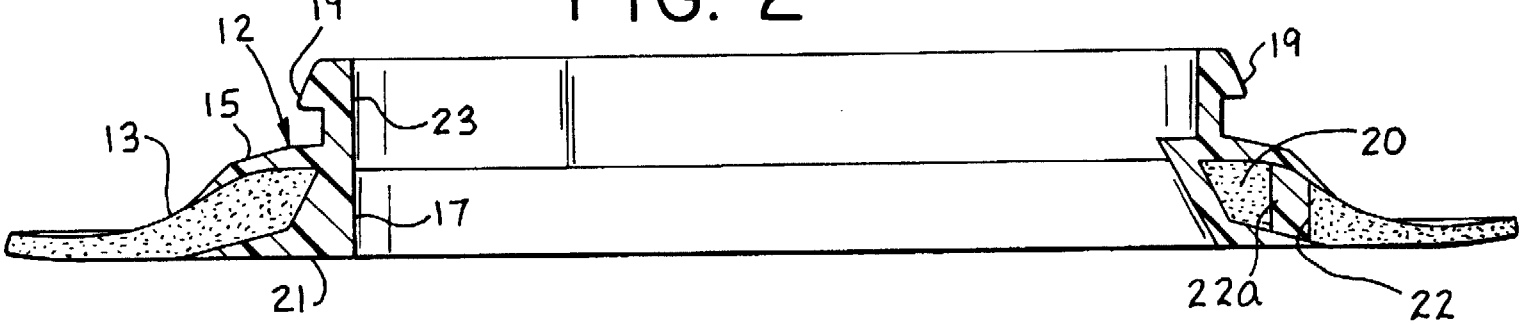
FIG. 2 is a cross-sectional view of the unitary stabilizing base of the first preferred embodiment.

As shown in the cross-sectional view of FIG. 2, the upper clamping portion 15, the inner portion 17, and the locking lip 19 are preferably integrally molded into a single unitary piece 12. A lower clamping portion 21 is also molded into the unitary piece 12. The tire sidewall 13 is secured to the unitary piece 12 by the upper clamping portion 15 and the lower clamping portion 21. In the presently preferred embodiment, an adhesive is applied to the bead 20 of the tire sidewall 13, before the upper clamping portion 15 and the lower clamping portion 21 are overmolded around the bead 20. Optionally, instead of or in addition to using an adhesive to attach the tire sidewall 13 to the clamping portions 15 and 21, prior to overmolding, one or more holes 22 may be found through the tire sidewall 13. Then, during the overmolding process, rubber flows into and fills the hole or holes 13, so that when the overmolded unitary piece 12 is cured, a rubber bolt 22*a* mechanically interconnects the tire sidewall 13 to the upper clamping portion 15 and lower clamping portion 21.

Figure 3:
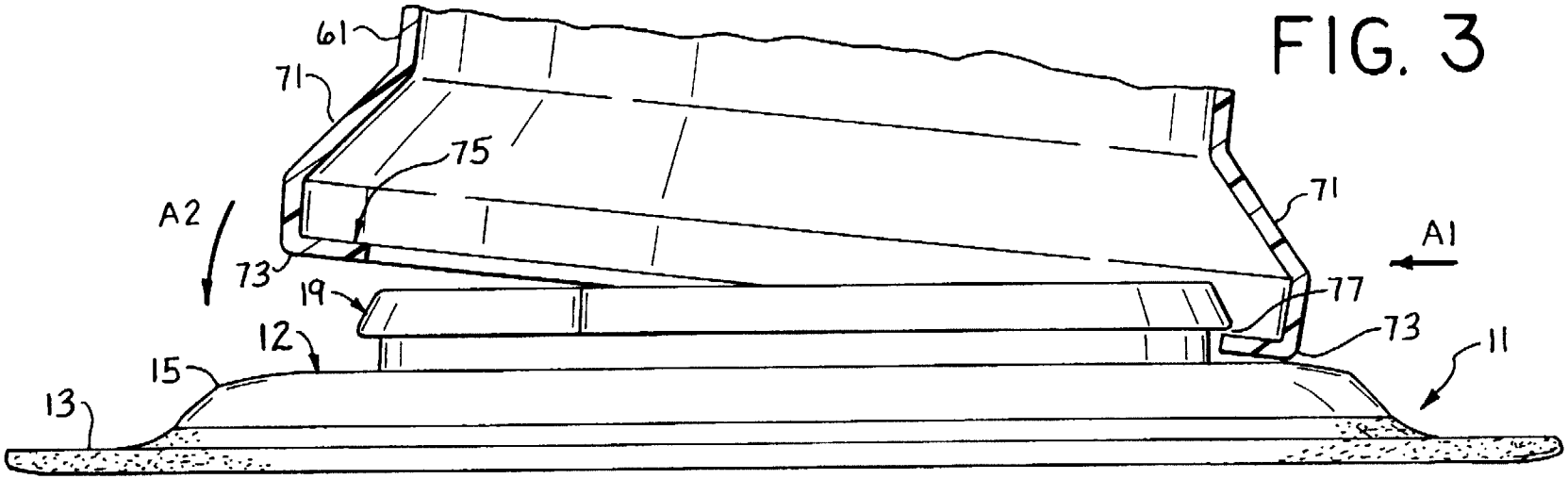
FIG. 3 is a perspective view of the unitary stabilizing base of the first preferred embodiment.

A perspective view of the unitary stabilizing base 11 is shown in FIG. 3. The tire sidewall 13 contacts a horizontal supporting surface, such as a roadway (not shown). The unitary piece 12 is connected to the tire sidewall 13 and extends radially inwardly of the tire sidewall 13. The unitary piece 12 may be molded with a strengthening agent added to prevent any sagging thereof.

Figure 4:
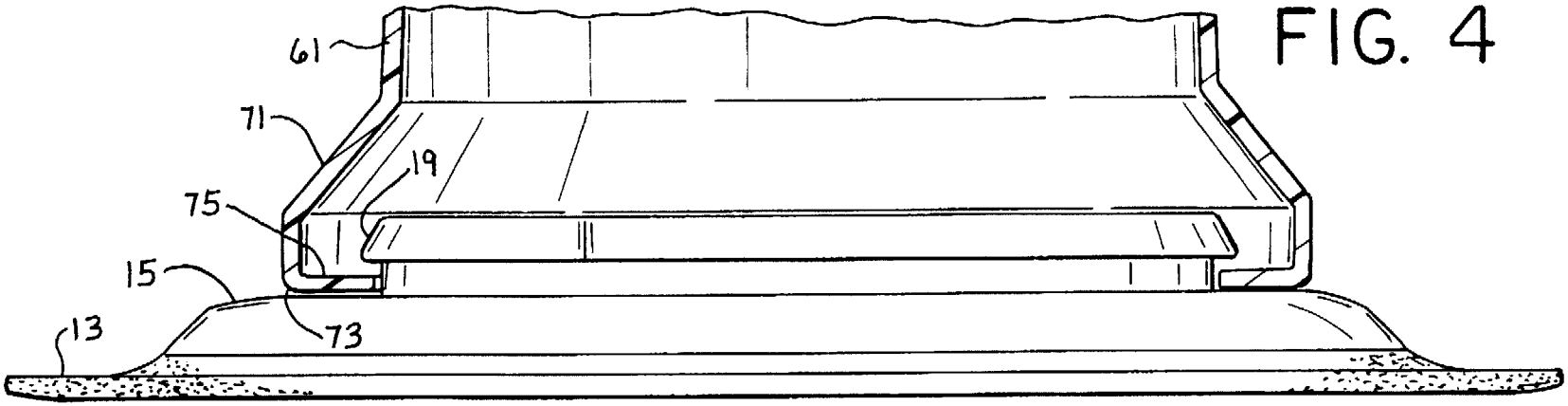
FIG. 4 is a cross-sectional view of the unitary stabilizing base of the first preferred embodiment and a traffic channelizer drum.

As shown in FIGS. 3 and 4, a traffic channelizer drum 61 may be secured onto the unitary stabilizing base 11, preferably by a pivoting action. The traffic channelizer device 61 is preferably of a conventional construction, as disclosed in commonly assigned U.S. Pat. No. 5,026,204, and comprises a skirt portion 71. The skirt portion 71 transitions into a circumferential corner portion 73, which terminates in a circumferential locking lip 75. In order to detachably secure the traffic channelizer device 61 to the unitary stabilizing base 11, a portion of the circumferential corner 73 is placed onto the top surface of the unitary piece 12. The portion of the circumferential corner 73 is preferably placed into contact with the top surface of the unitary piece 12 near the straight edge 25 (FIG. 1) of the raised circumferential wall 23. The entire traffic channelizer drum 61 is then moved in the direction of the arrow A1 to thereby move the circumferential locking lip 75 beneath the locking lip 19 of the unitary stabilizing base 11. A portion of the locking lip 19 should preferably contact the inner surface 77 of the locking lip 75, when the traffic channelizer device 61 is moved in the direction of the arrow A1. After the portion of the locking lip 19 has contacted the inner surface 77, an opposing portion of the circumferential corner 73 is moved in the direction of the arrow A2. The circumferential locking lip 75 is then forced over the corresponding portion of the locking lip 19 to thereby generate a secure mechanical fit between the traffic channelizer drum 61 and the unitary stabilizing base 11.

Figure 5:
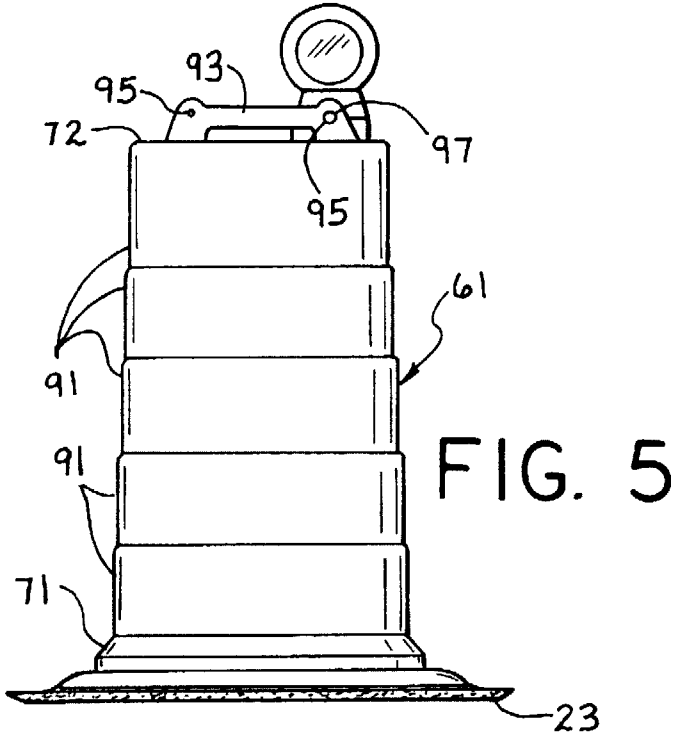
FIG. 5 is a side elevational view of the unitary stabilizing base of the present invention attached to a traffic channelizer drum.

Once the traffic channelizer drum 61 is secured to the unitary stabilizing base 11, the unitary stabilizing base 11 serves as a ballasting device to prevent the traffic channelizer drum 61 from moving or tipping over. The unitary stabilizing base 11 comprises a relatively large surface area and a low profile for preventing the traffic channelizer drum 61 from walking or creeping on the horizontal supporting surface due to wind or vacuum caused by passing vehicles. As shown in FIG. 5, the traffic channelizer drum 61 preferably comprises a relatively thin walled, hollow drum that is desirably blow molded out of a relatively lightweight, deformable plastic material such as a high or low density polyethylene. The traffic channelizer drum 61 is desirably stepped radially inwardly at discrete intervals along the axial length of the traffic channelizer drum 61 from the skirt portion 71 toward the top portion 72. The axially spaced surfaces 91 facilitate stacking of several traffic channelizer drums 61 for easy handling and storage. The axially spaced surfaces 91 are preferably slightly recessed, with respect to one another, to protect bands of reflective sheeting applied to one or more of the surfaces 91 against damage during stacking. Protruding axially outwardly from the top portion 72 of the traffic channelizer drum 61 is an integrally molded handle 93 for facilitating carrying of the traffic channelizer drum 61 from one location to another. Additionally, suitable mounting apertures 95 are placed within the handle 93 for attachment of standard warning devices thereto. For example, a fastener 97, such as a bolt, may secure a warning light 99 to the handle 93.

The traffic channelizer drum 61 can be attached and removed from the unitary stabilizing base 11 with relative ease. The unitary stabilizing base 11 does not need to be lifted up and above the traffic channelizer drum 61 for attachment or removal and, instead, a simple pivoting action can be used for securing the circumferential locking lip 75 of the traffic channelizer drum 61 to the locking lip 19 of the unitary stabilizing base 11. When the unitary stabilizing base 11 is placed upon a horizontal supporting surface, the inner portion 17 extends a height above the horizontal supporting surface. The height is preferably large enough to accommodate a raised circumferential wall 23 of another unitary stabilizing base, to thereby facilitate stacking of several unitary stabilizing bases 11 on top of one another.

Although a tire sidewall 13 is secured to the unitary piece 12 in the presently preferred embodiment, the single unitary piece 12 alternatively may be molded to include the shape of a tire sidewall 13, to thereby do away with the need for attachment of a tire sidewall 13. The tire sidewall 13, if used, is preferably formed from a 22.5 inch truck tire wall cut to between 37 and 39 inches outside diameter. This tire sidewall 13 preferably weighs approximately 27 pounds, and the unitary piece 12 preferably weighs approximately 13 pounds, for a total weight of approximately 40 pounds.

A particular advantage of the present invention over the prior art arrangement disclosed in U.S. Pat. No. 5,234,280 to Cowan is that, while the worn truck tire 13 is the primary inexpensive and durable ballast, the overmolded rubber portion 12 provides additional weight to stabilize the drum during high wind conditions, thereby helping to avoid the need to stack two tires. Furthermore, the design of the overmolded portion 12, including the locking lip 19, permits the drum 61 to be easily snap connected to the base 11.

Also, upon impact by a vehicle, the inventive design significantly reduces damage to the drum because the drum easily and cleanly separates from the base 11, as opposed to the Cowan design, wherein the separation process requires pulling the semi-rigid flange of the drum through the smaller steel-bead reinforced inside diameter of the rubber sidewall.

Yet another advantage of the present invention over the Cowan arrangement is that the drum 61 is generally "D"-shaped, rather than round as in the Cowan drum, and the locking lip 19 of the base 11 is "D"-shaped as well, to complement the shape of the drum, having the straight edge 25. The "D" shape is advantageous because when a channelizing drum is fitted with a barricade light, like light 99 of the present invention, the fact that the light is offset from the centerline of the drum causes the drum to have a tendency to rotate about its axis due to high winds generated by passing vehicles. It has been found by the inventors that a round drum configuration tends to rotate very badly, while the "D"-shaped drum and complementary "D"-shaped locking lips 19 of the base 11 tend to resist rotation.

Figure 6:
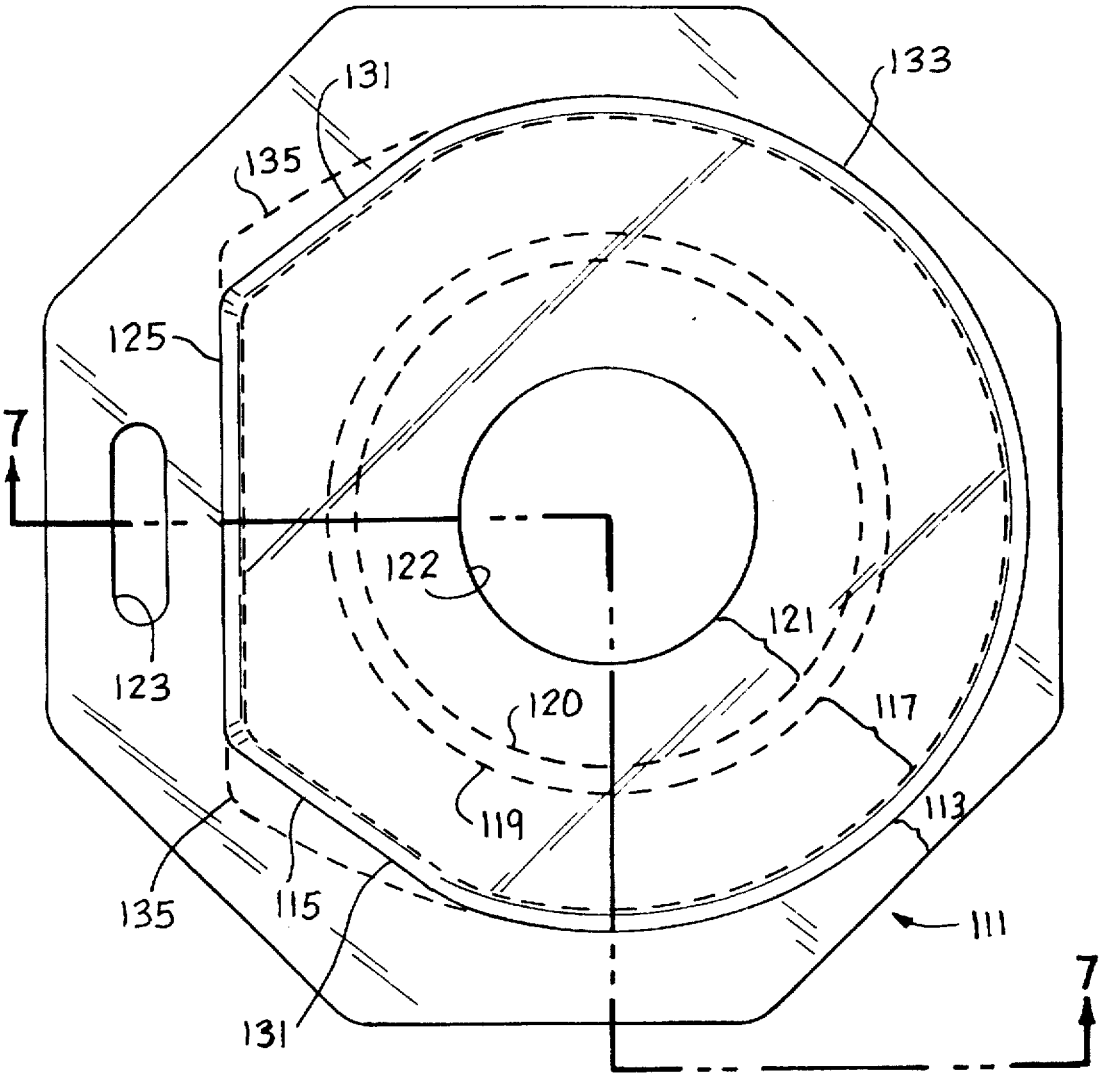
FIG. 6 is a top planar view of the unitary stabilizing base, according to a second preferred embodiment of the present invention.

Turning now to FIG. 6, a top planar view of a unitary stabilizing base 111, according to a second preferred embodiment, is illustrated. The unitary stabilizing base 111 comprises an outer portion 113, a locking lip 115, an intermediate portion 117, a first step 119, a second step 120, an inner portion 121, and a drain aperture 122. A handle aperture 123 is disposed in the outer portion 113 to facilitate gripping and movement of the unitary stabilizing base 111 by the hand of a user.

Figure 7:
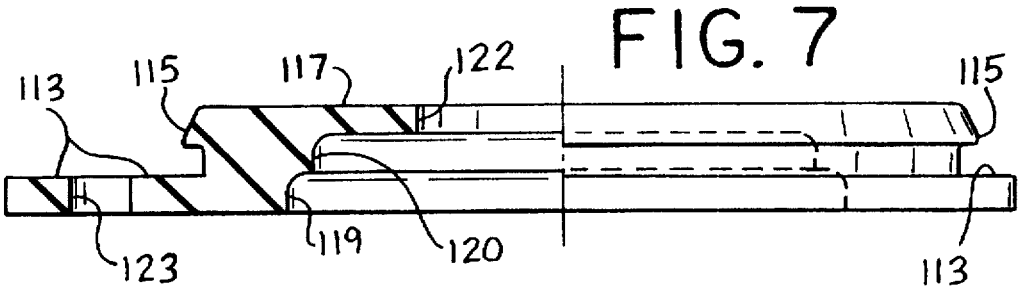
FIG. 7 is a cross-sectional view of the unitary stabilizing base of the second preferred embodiment of the present invention.

As shown in the cross-sectional view of FIG. 7, taken along the lines 7, 7 of FIG. 6, the unitary stabilizing base 111 is preferably integrally molded of non-vulcanized reclaimed rubber. The outer portion 113 is adapted for contacting a horizontal supporting surface, and for supporting the intermediate portion 117 and the inner portion 121, both of which are located radially inwardly of the outer portion 113. The locking lip 115 is disposed between the outer portion 113 and the intermediate portion 117, and is configured similarly to the locking lip 19 of the first preferred embodiment. The locking lip 115 facilitates attachment of a traffic channelizer drum similar to the function of the locking lip 19, as discussed above with reference to FIG. 3–5.

The first step 119 and the second step 120 facilitate easy 360 degree gripping and carrying of the unitary stabilizing base 111 by the hand of the user, in addition to or as an alternative to use of the handle aperture 123. A user's fingers can contact the curved portions of the first step 119 and/or the second step 120, for example. A greater or smaller number of steps may be implemented, according to preference. The inner portion 121 extends radially inwardly of the first step 119 and the second step 120, and forms the drain aperture 122. Additionally, unlike in the first embodiment, a sandbag may be placed over the unitary stabilizing base 111 for additional weight and ballast before the traffic channelizing drum 61 is secured to the unitary stabilizing base 111. The first step 119, second step 120, and inner portion 121 of the second preferred embodiment are adapted to bend slightly under the weight of the sandbag. In particular, the bending of the inner portion 121 of the unitary stabilizing base 111 forms a centered pocket under the sandbag to thereby facilitate centering of the sandbag over the unitary stabilizing base 111. The centering of the sandbag on the unitary stabilizing base 111 provides a more stable foundation for the drum. Optionally, the unitary stabilizing base 111 may be molded with a strengthening agent added to the intermediate portion 117 and/or inner portion 121, or to the entire unitary stabilizing base 111. Such a strengthening agent can be added to attenuate the amount of sagging of the inner portion 121, according to preference.

A particularly advantageous feature of the FIG. 6 embodiment is the inclusion of squared-off portions 131 on the base locking lip 115 on either side of the straight edge portion 125. These squared-off portions 131 are preferably molded to deviate from the natural continuation of the curved locking lip portion 133, which is represented by the phantom lines 135. The purpose for the squared-off portions 131 is to permit easier attachment and detachment of the drum 61 to the base 111. Attachment is easier because, in order to make the drum-base attachment, the drum must be deformed at some point about its circumference to engage or disengage the lip 19. Since the outer circumference of the drum tracks the phantom lines 135, the space between the locking lip 75 of the drum and the squared-off portion 131 permits easy deformation of the drum flange to thereby facilitate ready engagement or disengagement of the drum and the base.

This feature may also be incorporated into the FIG. 1 embodiment, if desired, where squared-off portions 31 are illustrated.

Although exemplary embodiments of the invention have been shown and described, many other changes, modifications and substitutions, in addition to those set forth in the above paragraph, may be made by one having ordinary skill in the art without necessarily departing from the spirit and scope of this invention.

What is claimed:

1. A unitary stabilizing base adapted for being connected to a traffic channelizer drum, comprising:

a side wall of a vehicle tire, the side wall having an inner edge and an outer edge, and further having a lower side for contacting a horizontal support surface and an upper side opposite the lower side;

an intermediate portion for contacting the inner edge of the side wall and for joining the side wall to the intermediate portion; and a circumferential wall connected to the intermediate portion, the circumferential wall having at least one locking lip adapted to be engaged with the traffic channelizer drum to thereby connect the traffic channelizer drum to the unitary stabilizing base;

wherein the intermediate portion contacts both the lower side of the sidewall and the upper side of the sidewall.

2. The unitary stabilizing base according to claim 1, wherein the side wall is annular in shape, the intermediate portion is generally annular in shape, and the circumferential wall is generally annular in shape.

3. The unitary stabilizing base according to claim 2, wherein the side wall, the intermediate portion, and the circumferential wall are all generally concentric.

4. The unitary stabilizing base according to claim 1, wherein the intermediate portion is molded around the lower side of the sidewall and the upper side of the sidewall.

5. The unitary stabilizing base according to claim 4, wherein an adhesive is applied between the intermediate portion and the inner edge of the side wall, before the intermediate portion is molded around the lower side of the sidewall and the upper side of the sidewall.

6. The unitary stabilizing base according to claim 4, wherein the intermediate portion and the circumferential wall are integrally molded together.

7. The unitary stabilizing base according to claim 4, wherein the intermediate portion and the circumferential wall are integrally molded together of nonvulcanized reclaimed rubber.

8. The unitary stabilizing base according to claim 7, further comprising a strengthening agent added to the intermediate portion and the circumferential wall during the molding of the intermediate portion and the circumferential wall.

9. A unitary stabilizing base for detachably holding a traffic channelizer drum above a horizontal support surface, comprising:

an outer portion adapted for contacting the horizontal support surface;

an intermediate portion connected to the outer portion and being disposed radially inwardly of the outer portion, the intermediate portion having an inner surface that defines an aperture in the intermediate portion; and at least one step disposed on a first portion of the inner surface of the intermediate portion, the step being grippable by a hand of a user and forming a first diameter across the aperture that is smaller than a second diameter across the aperture of a second portion of the inner surface.

10. The unitary stabilizing base according to claim 9, further comprising at least one locking lip, connected to the intermediate portion, the locking lip being adapted for engagement with an inner rim of the traffic channelizer drum to thereby connect the traffic channelizer drum to the unitary stabilizing base.

11. The unitary stabilizing base according to claim 10, wherein the step comprises a curved surface.

12. The unitary stabilizing base according to claim 9, further comprising an inner portion connected to the intermediate portion and being disposed radially inwardly of the intermediate portion, the inner portion having an inner surface that defines a drain aperture in the inner portion.

13. The unitary stabilizing base according to claim 12, wherein the unitary stabilizing base is adapted for accommodating a ballast thereon, the ballast fitting over both the drain aperture and the inner portion.

14. The unitary stabilizing base according to claim 13, wherein the inner portion is adapted for bending under a weight exerted by the ballast, the bending of the inner portion forming a recess around the drain aperture for accommodating the ballast.

15. The unitary stabilizing base according to claim 14, wherein the recess around the drain aperture functions to center the ballast above the unitary stabilizing base.

16. The unitary stabilizing base according to claim 15, wherein the ballast comprises a sandbag.

* * * * *